United States Patent [19]

Knox

[11] Patent Number: 4,942,333

[45] Date of Patent: Jul. 17, 1990

[54] SHADOW MASK WITH BORDER PATTERN

[75] Inventor: Lawrence D. Knox, Milford, Mass.

[73] Assignee: North American Philips Corporation, New York, N.Y.

[21] Appl. No.: 279,889

[22] Filed: Dec. 5, 1988

[51] Int. Cl.[5] ..... H01J 29/07

[52] U.S. Cl. ..... 313/402; 313/407

[58] Field of Search ..... 313/407, 402

[56] References Cited

U.S. PATENT DOCUMENTS 4,652,791 3/1987 Palac et al. ..... 313/407 X 4,767,962 8/1988 Adler et al. ..... 313/402

FOREIGN PATENT DOCUMENTS 2603742 8/1977 Fed. Rep. of Germany ..... 313/407

57776 5/1977 Japan ..... 313/407

*Primary Examiner*—Palmer C. DeMeo

*Attorney, Agent, or Firm*—John C. Fox

[57] ABSTRACT

A shadow mask adapted for tensioned mounting in a flat faced color CRT is characterized by having a pattern of slits in the border regions of the mask in order to provide uniform distribution of tensile stresses across the mask when mounted in the CRT, resulting in improved mechanical and thermal behavior, and enabling the separate fabrication of the mask and display screen of the CRT.

6 Claims, 3 Drawing Sheets

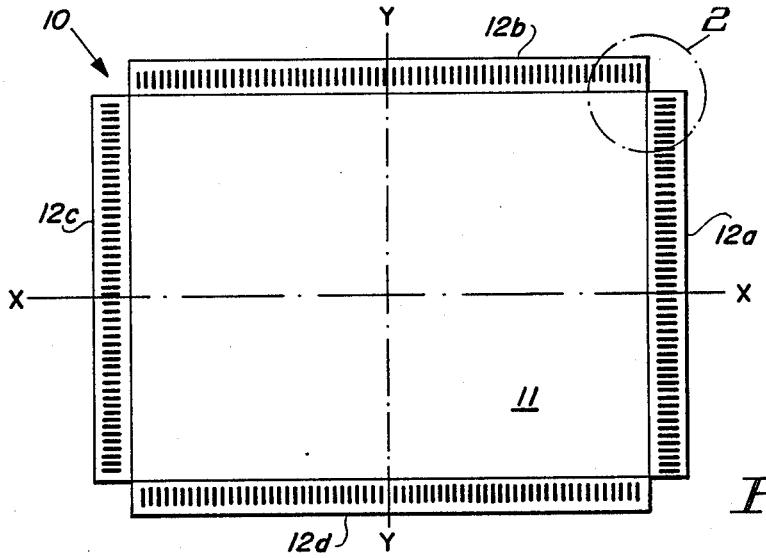
FIG. 1
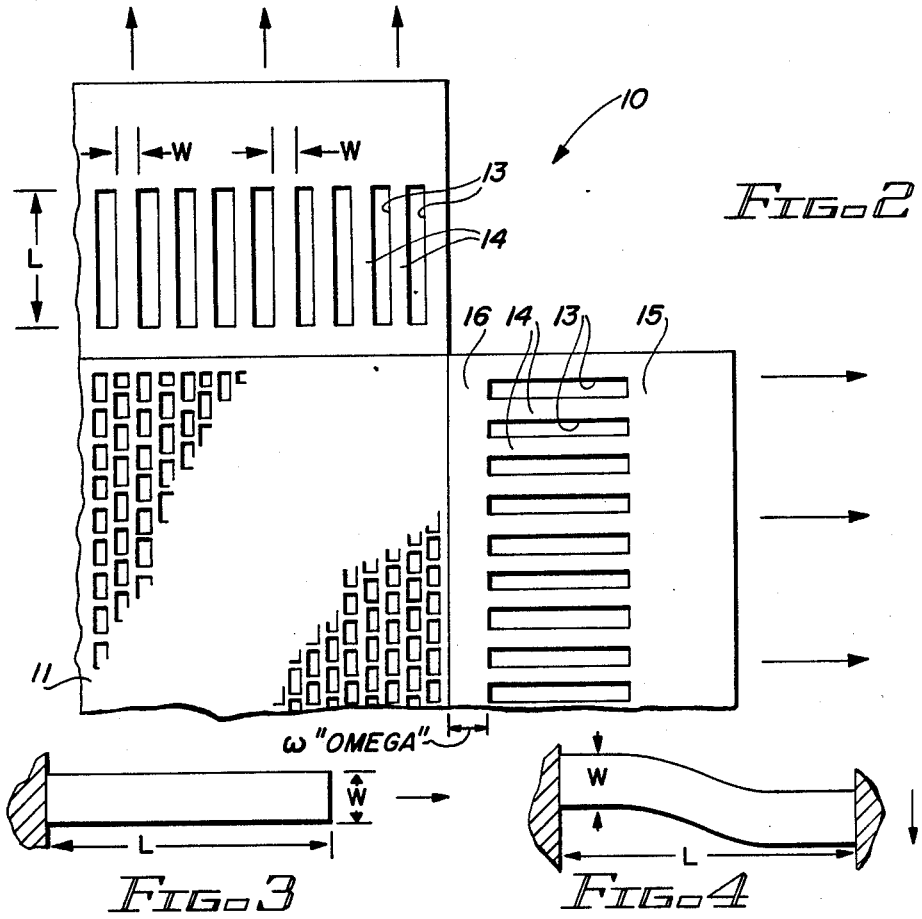
FIG. 2
FIG. 3
FIG. 4

SHADOW MASK WITH BORDER PATTERN

BACKGROUND OF THE INVENTION

This invention relates to a shadow mask for a flat faced cathode ray tube (CRT) for color display, and more particularly relates to such a mask having a border pattern.

Cathode ray tubes for color television and allied display applications typically employ a shadow mask to shadow (spatially filter) the electron beams coming from the three electron guns mounted in the neck of the tube, such that each beam excites only one color of a three-color phosphor display screen disposed on the internal surface of the face of the tube. This shadowing is accomplished by providing an array of apertures in the mask corresponding to an array of phosphor elements in the screen.

Conventional CRT faces are curved. Currently, two-dimensional (cylindrical) or three-dimensional (quasi-spherical) curvatures are employed. Although CRTs have recently been developed which have faces with reduced curvatures, it would be desirable for a number of reasons, including aesthetic appearance, reduced ambient light reflections and fabrication costs, to have a CRT with a face with no curvature at all.

A flat-faced CRT is currently being developed in which the shadow mask is tensioned behind the flat display surface, much like a drum skin, to provide structural rigidity and to overcome thermal distortion problems during operation. A uniform stress distribution in this mask is desirable since this allows the use of higher tensioning stresses which further improves the structural and thermal behavior. Such tensioning stresses could be as high as 60 to 80% of the yield stress of the mask material.

Additional advantages in tube design and cost of automation could be realized if a "non-married" fabrication process could be used, that is, the shadow mask and phosphor patterns are produced independently, rather than dependently as is the present practice for conventional color CRTs. To achieve such a "non-married" fabrication process, the accuracy of aperture and phosphor element placement within 5 to 10 microns must be uniformly achievable.

U.S. Pat. No. 3,500,100 relates to a character display tube having a mask with a compliant area surrounding an indicia area to minimize distortion of the indicia area. This concept is inappropriate for use with a tensioned mask in a flat-faced color CRT, since it would keep the central viewing area of the mask essentially stress free.

OBJECT AND SUMMARY OF THE INVENTION

It is an object of this invention to provide a border pattern surrounding the apertured (viewing) area of a tensioned shadow mask, which border pattern provides a uniform stress distribution in the viewing area of the mask when the edges of the mask are subjected to either a uniform displacement or a uniform edge loading.

In accordance with the invention, a border pattern is provided on a rectangular shadow mask for tensioned mounting in a flat faced color CRT. The border of the mask comprises strips of material surrounding the central, apertured (viewing) area of the mask. In each strip, slits which are mutually parallel to one another and orthogonal to the adjacent edge of the apertured area, form legs, also orthogonal to the edge of the apertured area. These legs connect the apertured area to outer regions of the border strips used to secure the mask to the CRT.

The length of and spacing between the slits are chosen to provide a border which is relatively stiff in tension, but relatively flexible in transverse bending. The ratio of the length L to the spacing W between adjacent edges of the slits, referred to herein as the aspect ratio, varies as the square of the ratio of the tensile stiffness to the bending stiffness.

In addition, the transverse bending should be small relative to the length L to assure that the tensile forces are substantially orthogonal to the adjacent edge of the apertured area.

BRIEF DESCRIPTION OF THE DRAWINGS

FIG. 1 is a schematic diagram of a shadow mask for a color flat faced color cathode ray tube of the invention, including a border region having a pattern of slits;

FIG. 2 is an enlarged portion from the circled area of FIG. 1, showing in more detail the pattern of slits in the border region;

FIG. 3 is a diagramatic representation for tensile stress analysis of a leg of border material between adjacent slits of the border pattern;

FIG. 4 is a diagram similar to that of FIG. 3 for transverse bending stress analysis;

DESCRIPTION OF THE PREFERRED EMBODIMENTS

Figure 5:
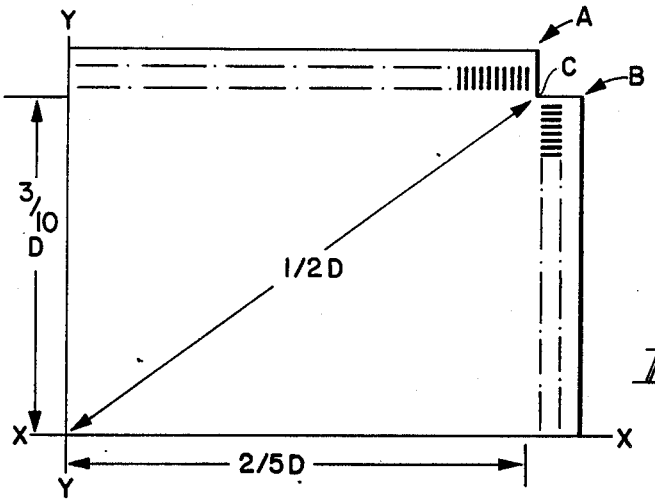
FIG. 5 is a graphic representation of the upper right quadrant of the mask of FIG. 1.

Referring now to FIG. 1, there is shown one embodiment of a shadow mask for a flat faced color CRT in accordance with the invention. The mask 10 comprises a rectangular central apertured or viewing region 11, and border region 12 comprising members 12*a, b, c* and *d*, each member including a pattern of mutually parallel slits 13 oriented orthogonally to the adjacent edge of the viewing area. The aperture pattern and border pattern may be produced simultaneously by selectively etching chemically a single sheet of thin metal, in accordance with known practice.

As may be better seen in FIG. 2, an enlarged portion of the mask from the circled area of FIG. 1, the slits 13 in the border elements 12 form many parallel legs 14, which connect outer solid strips 15 to the viewing area 11 via inner strips 16. Strips 15 are used to secure the mask to the tube. Due to this border pattern, the members 12 are relatively stiff when tensile forces are applied axially, that is, in the direction of the arrows shown in FIG. 2, and relatively flexible in transverse bending, that is, transverse to the direction of the arrows. Thus, the members tend to effectively transmit the tension forces required, but tend to absorb bending forces which would otherwise disturb the uniform stress distribution desired in the mask.

The width of the slits is preferably kept as small as possible. When the slits are produced by conventional chemical etching, the width is typically about 5 mils in the upper surface of the mask, which is just sufficient to allow penetration of the lower surface of the mask by the etchant.

As shown in FIG. 2, each leg 14 has a length L and a width W. The ratio of the length L to the width W, herein the aspect ratio, must be sufficiently large to achieve the desired relative stiffness in tension and flexibility in transverse bending.

Referring to FIG. 3, a stress analysis diagram of one of the legs 14 subjected to a tensile stress as indicated by the arrow, the tensile stiffness $K_1$ of the leg is equal to $E \times A/L$, where E is the Young's modulus of the mask material, A is equal to mask thickness t times the leg width W, and L is the leg length.

FIG. 4 is a diagram similar to that of FIG. 3 for a leg subjected to a bending force as indicated by the arrow. Bending stiffness $K_2$ is equal to $12 \times E \times I/L^3$, where I is equal to $t \times W^3/12$. The ratio of $K_1$ to $K_2$ is then equal to $(L/W)^2$. By way of example, where a ratio $K_1/K_2$ of 100 is desired, the aspect ratio L/W is 10.

An additional consideration in the design of the mask of the invention is that the transverse bending should be small relative to the length of the slit to assure that tensioning forces are substantially parallel to the mask axis intersecting the border element. The magnitude of the transverse bending is in turn determined by the size of the mask and the tensioning level of the mask.

FIG. 5 is a graphic representation of the upper right quadrant of the mask of FIG. 1, which has a height along the Y axis three-fourths of the width along the X axis. The intersection of the X and Y axes corresponds to the center of the mask. The distance from the center to point C is designated as one-half D, where D is the diagonal of the viewing area. The height and width of the viewing area quadrant can then be expressed as 3/10 D and 2/5 D, respectively. The transverse bending near point A can then be expressed as $$B = \sigma_h - 2/5\ D$$

where $\sigma_h$ is the average horizontal strain. The transverse bending near point B will be $$B = \sigma_v - 3/10\ D$$

where $\sigma_v$ is the average vertical strain. In practice, $\sigma_h$ is approximately equal to $\sigma_v$, which is approximately equal to $500 \times (E-6)$. For a mask material having a modulus of elasticity E of 30 E6 psi, and a diagonal D of 27", B is approximately equal to 0.005". For a diagonal D of 16", B is approximately equal to 0.003". As higher yield strength materials are used, the strains will increase due to increased tension loads of as much as two to five times. Depending upon the space available surrounding the viewing area of the mask, slit lengths up to 100 times the transverse bending can be accommodated.

In order to illustrate the advantages of the invention, two sets of prototype flat faced color CRTs with tensioned masks were built, one with a 27" mask diagonal and one with a mask 16" diagonal. Each set included a tube with a border pattern in the mask and a control tube with no border pattern in the mask. The values of L, W, and $\omega$ are as shown below:

| | 27" | 16" |
|---|---|---|
| L | 0.50" | 0.25" |
| W | 0.050" | 0.025" |
| $\omega$ | 0.050" | 0.02" |

In the control tubes, a pattern on the screen was observed having an edge distortion of about 100 micrometers near the edge of the viewing area. No evidence of this distortion was visible in the tubes having border patterns in accordance with the teachings of the invention.

As a further demonstration of the advantages of the invention, a finite element analysis was performed on the 27" diagonal shadow mask design, both with and without the border pattern, under uniform edge loading of 75 lbs./inch. The results are illustrated graphically in FIGS. 6 anbd 7 in which the rows of arrows along the border indicate uniform tensile loading, and in which the areas A through E represent areas of increasing amounts of displacement of the apertures in the viewing area as a result of the tensile loading.

Figure 6:
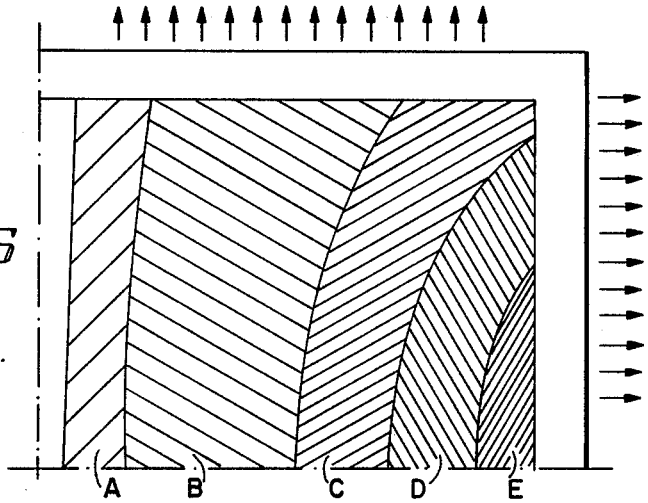
FIG. 6 is a graphic representation of the upper right quadrant of a tensioned mask similar to that of FIG. 1, but without a border pattern, under uniform tensile stress.
Figure 7:
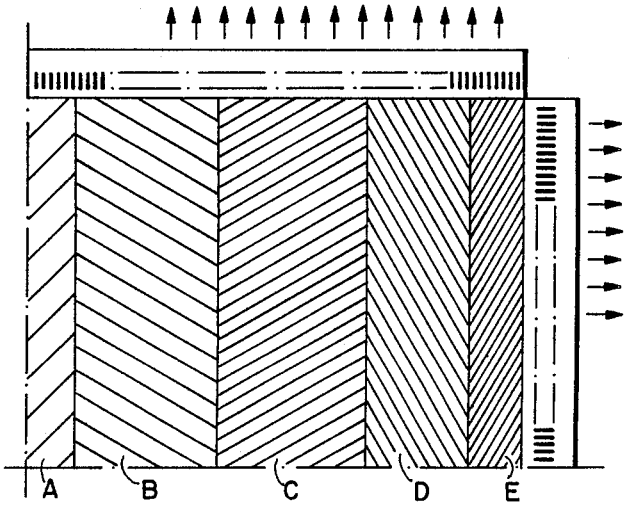
FIG. 7 is a graphic representation similar to that of FIG. 6 for a tensioned mask having a border pattern in accordance with the invention.
Figure 8:
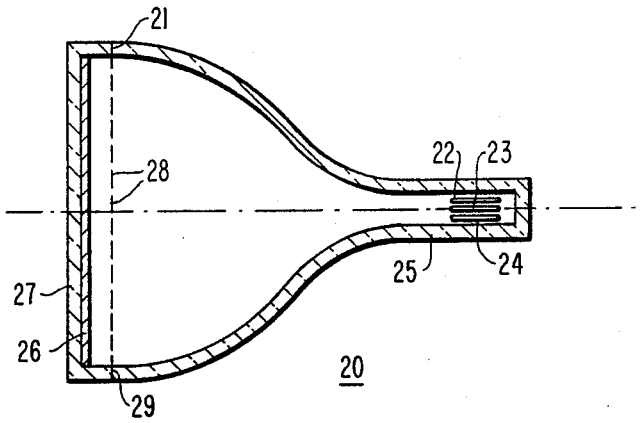
FIG. 8 is a diagrammatic representation in section of a flat faced color CRT including a tensioned mask of the invention.

As may be seen in FIG. 6, in the mask without the border pattern the stress distribution as evidenced by the aperture displacement is non-uniform due to uneven stress levels. However, as may be seen in FIG. 7, with the border pattern, the deformation is uniform due to uniform stress levels. Such uniform stress assures the ability to predict accurately the aperture pattern after tensile loading, enabling the accurate registration of the aperture pattern with a phosphor pattern on the display screen, and thus making possible the fabrication of the screen and mask separately. Referring now to FIG. 8, there is shown a longitudinal section view of a flat faced color CRT 20 employing atensioned mask 21 of the invention. The tube 20 includes three electron guns 22, 23 and 24, located in the tube meck 25, for directing electron beams through apertures 28 in mask 21 to phosphor screen 26, located on the inner surface of face 27. Mask 21 is mounted in tension behind screen 26 using outer strips 29, (corresponding to strips 15 in FIG. 2).

What is claimed is:

1. A shadow mask adapted for tensioned mounting in a flat faced color CRT, the mask comprising a central apertured viewing area and a surrounding border region, the border region comprising mounting strips connected to the viewing area by a plurality of legs, the legs mutually parallel and orthogonal to an adjacent edge of the viewing area, the border regions being relatively stiff in tension and relatively flexible in transverse bending.

2. The mask of claim 1 in which the legs are formed by a pattern of slits which are mutually parallel and orthogonal to the adjacent edge of the viewing area.

3. The mask of claim 1 in which the aspect ratio L/W of the legs is at least 5.

4. The mask of claim 3 in which the aspect ratio of the legs is up to 10.

5. The mask of claim 1 in which the magnitude of the transverse bending of the border regions is small relative to the length L of the legs.

6. A flat faced color CRT including the shadow mask of claim 1 mounted in tension.

* * * * *